United States Patent [19]

Sirota

[11] Patent Number: 4,740,186

[45] **Date of Patent: * Apr. 26, 1988**

[54] DOLL

[76] Inventor: Vladimir Sirota, 130 W. 67 St., New York, N.Y. 10023

[ * ] Notice: The portion of the term of this patent subsequent to Jul. 22, 2003 has been disclaimed.

[21] Appl. No.: 831,711

[22] Filed: Feb. 21, 1986

Related U.S. Application Data

[63] Continuation-in-part of Ser. No. 734,173, May 15, 1985, Pat. No. 4,601,668.

[51] Int. Cl.[4] ..... A63H 3/00; A63H 3/28

[52] U.S. Cl. ..... 446/14; 446/175; 446/303; 446/295

[58] Field of Search ..... 446/14, 26, 130, 175, 446/295, 296, 297, 301, 303, 304, 472, 219, 485; 434/262, 266; 340/521, 628, 573, 575; 353/74

[56] References Cited

U.S. PATENT DOCUMENTS

| | | | |
|---|---|---|---|
| 1,900,353 | 3/1933 | Marchetti | 446/175 |
| 2,159,838 | 5/1939 | Bregman | 446/219 X |
| 2,592,444 | 4/1952 | Matelena | 353/74 X |
| 2,688,689 | 9/1954 | Christopher | 446/485 X |
| 2,990,646 | 7/1961 | Berger | 446/175 |
| 3,184,886 | 5/1965 | Weih | 446/295 |
| 3,514,899 | 6/1970 | Bonanno et al. | 446/304 X |
| 3,561,861 | 2/1971 | Mayer | 353/74 X |
| 4,072,314 | 2/1978 | Rosen et al. | 446/485 X |
| 4,155,196 | 5/1979 | Bollinger et al. | 446/130 |
| 4,601,668 | 7/1986 | Sirota | 446/295 X |
| 4,605,380 | 8/1986 | Camm et al. | 446/295 X |
| 4,622,771 | 11/1986 | Spengler | 446/219 X |
| 4,623,318 | 11/1986 | Tsiknopoulos et al. | 446/219 X |

FOREIGN PATENT DOCUMENTS

| | | | |
|---|---|---|---|
| 0032843 | 7/1981 | European Pat. Off. | 446/301 |
| 1117254 | 5/1956 | France | 446/296 |

*Primary Examiner*—Robert A. Hafer
*Assistant Examiner*—Danton D. DeMille

[57] ABSTRACT

A doll has a doll element, a plurality of sensors which sense different parameters of an environment in the vicinity of the doll, and an electronic device which forms, in response to sensing of at least parameter by the sensors, an image of solid expanding and contracting heart in the doll element.

26 Claims, 4 Drawing Sheets

DOLL

The instant invention is a continuation-in-part of my prior application Ser. No. 734,173 filed May 15, 1985, which issued July 22, 1986 as U.S. Pat. No. 4,601,668 and also relates to my other copending applications, Ser. No. 858,733 filed May 2, 1986 and Ser. No. 887,365 filed July 17, 1986.

BACKGROUND OF THE INVENTION

The present invention relates to a doll.

Many different dolls are known in the art and used by children for amusing and educational purposes. One of the main purposes of having a doll is to give a child the possession of a human-like toy which gradually generates deep attachment between the child and the doll. The warmer the relationship between the child and the doll, the better is the educational and humane value of the doll. It is also important that the doll imitates a real human being by reaction to environmental factors or irritants, similar to the human reactions, for example reaction to sharp increase or decrease of temperature, high level of noise, smoking etc. It is also important if the doll reacts to rocking similarly to a child which is rocked to sleep. The greater is the resemblance of the doll to a human being, the higher is its attractiveness for a child.

SUMMARY OF THE INVENTION

Accordingly, it is an object of the present invention to provide a doll which provides for increasing attractiveness and educational value.

More particularly, it is an object of the present invention to provide a doll which reacts to an enviroment with a human-like reaction, namely by beating of the doll's heart in visual and audio mode.

In keeping with these objects and with others which will become apparent hereinafter, one feature of the present invention resides in a doll which has a doll element, sensing means which sense at least one parameter of an enviornment in the vicinity of the doll element, and electronic means which form the image of solid expanding and contracting heart in the response to sensing of at least one parameter by the sensing means. The heart can "vibrate" in response to temperature (very high, or very low), excessive sound (noise), and smoking people (smoke). Also, sounds of a heart beat can be produced in this situation. A doll can cry in response to the above factors, and then be silenced by rocking the doll. The silencing can be performed with a delay (not immediately) and by gradual weakening of the crying sound.

The novel features of the present invention are set forth in particular in the appended claims. The invention itself, however, will be best understood from the following description of preferred embodiments, which is accompanied by the following drawings.

DESCRIPTION OF THE PREFERRED EMBODIMENTS

Figure 1:
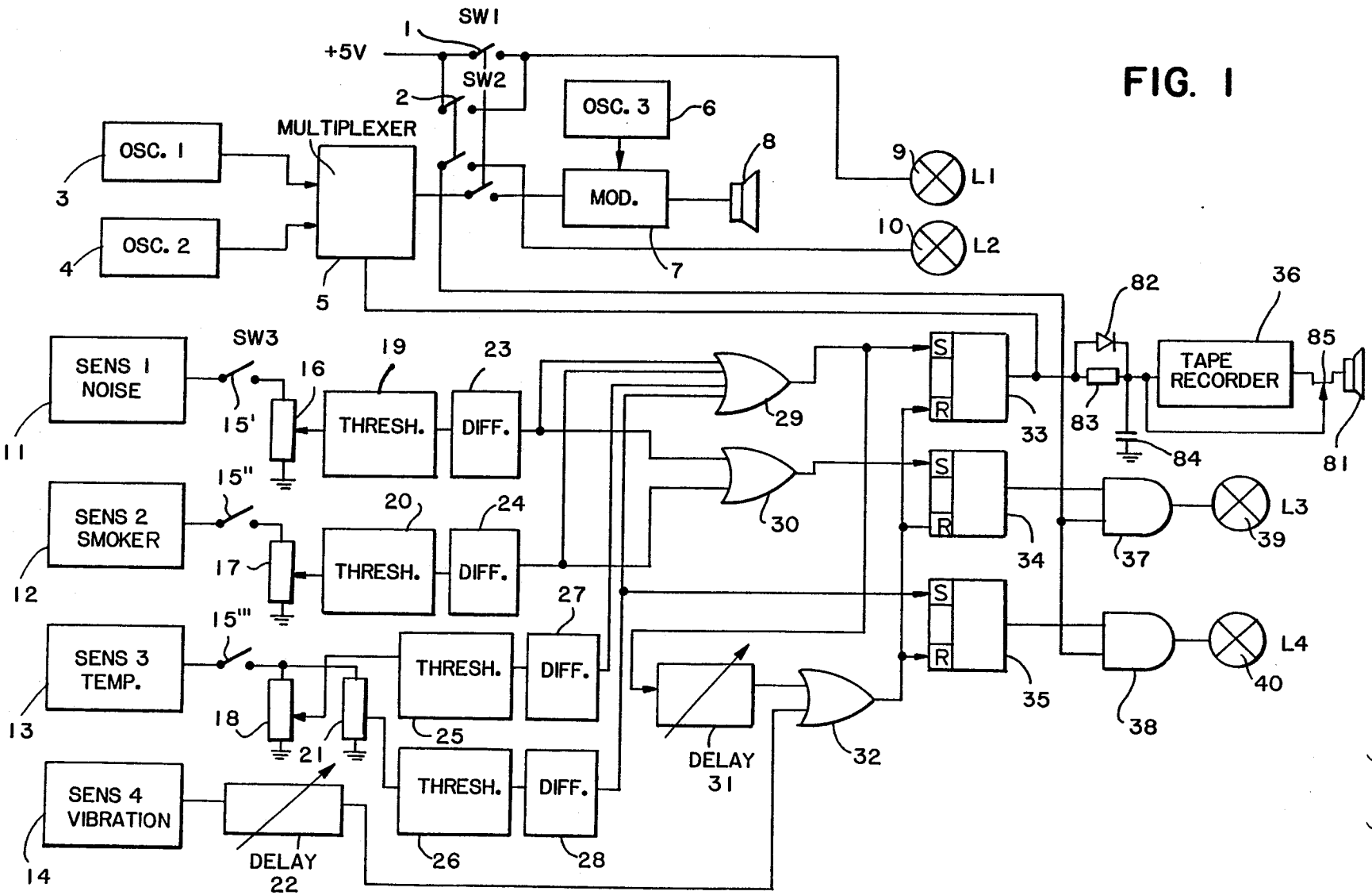
FIG. 1 is a block-diagram which schematically shows a doll's operation in accordance with the present invention.
Figure 2:
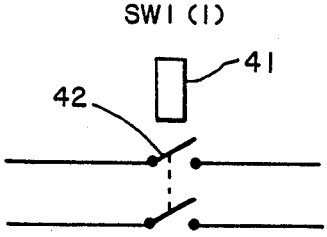
FIG. 2 is a view showing a switch which cooperates with a toy stethoscope of the invention doll, to actuate the doll temporarily.

A doll in accordance with the present invention has a doll housing in which electronic means is provided. The electronic means includes two interconnected parts which will be explained in detail hereinbelow. One part of the electronic means includes two switches 1 and 2, two generators (oscillators) 3 and 4 which generate impulse signals of different frequency, a multiplexer 5, a generator] (oscillator) 6, a modulator 7, a sound transducer 8 (a dynamic) and two light sources 9 and 10 formed for example as shown in FIG. 4.

Figure 4:
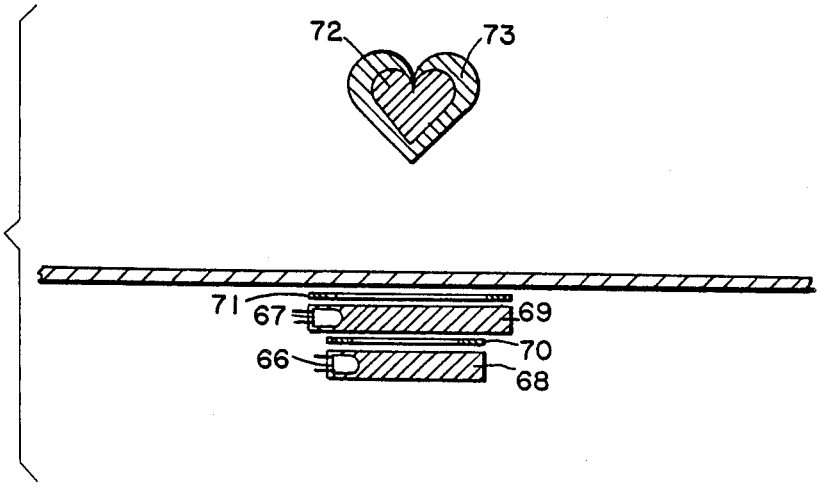
FIG. 4 is a view showing a display on which an image of expanding and contracting heart is formed in the inventive doll.

As shown in FIG. 4, the above light sources include two light emitting diodes 66 and 67 located one above the other, light conductors 68 and 69, and two masks 70 and 71 which have heart-shaped inner openings of different sizes (or heart-shaped transpatent areas of different sizes). The doll also includes a separate stethoscope-like element (stethiscope hereinbelow) 58 which is provided with a magnet 41. The above switches 1 and 2 are magnetically operated switches.

When the stethoscope 58 is applied to the doll so that the magnet 41 approaches the switch 1, the switch 1 is turned on. An impulse signal generated by the generator 6 (for example approximately 3000 Hz) is amplitude-modulated by another impulse signal generated by the generator 3 (approximately 1.2 Hz) which is supplied to the modulator 7 through the multiplexer 5. As a result of this, a pulsating sound is produced in the sound transducer 8, which imitates the frequency of pulse (heart) beats. At the same time the light source 9 (the light diode 66) is permanently turned on, while the other light source 10 (the light diode 67) emits pulsating light with the frequency of the generator 3 (1.2 Hz) so that the image of a smaller heart 72 is always lit, while the image of a greater heart 73 is periodically on and off (FIG. 4). Thereby, the image of expanding and contracting heart is produced.

The switch 1 is arranged, for example, at the left side. When the stethoscope 58 is withdrawn from the switch 1, the sound (8) and light (9,10) pulsation of the doll's "heart" stops.

Figure 3:
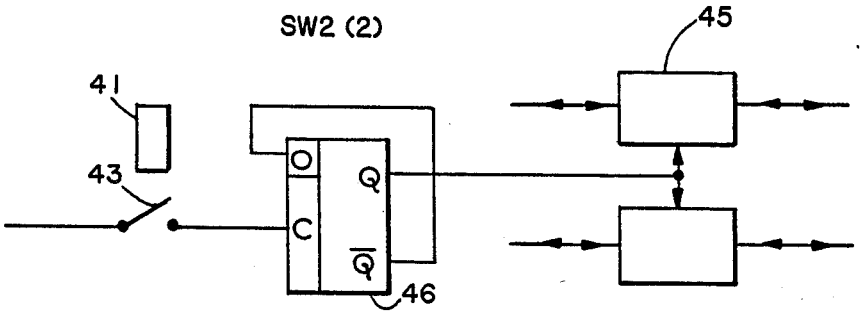
FIG. 3 is a view showing another switch cooperating with a toy stethoscope to actuate the doll permanently, in accordance with the invention.

The switch 2 is arranged in another area, for example at the right side of the doll's chest. It is shown in detail in FIG. 3 and includes a switching member 43, a trigger 44, and a transistor switch 45. With each approach of the magnet 41 of the stethoscope 58 to the switch 2 it changes its position from closed to open and vice versa. By means of the switch 2, a child can turn on the sound (8) and light (9,10) pulsation of the doll's heart for a permanent time, without self-turning off as in the case of the actuation of the switch 1.

Another part of the electronic means of the inventive doll includes four sensors 11, 12, 13 and 14, wherein 11 is a sensor of noise, 12 is a sensor of smoke, 13 is a sensor of temperature and 14 is a sensor of rocking. The sensors 11–14 sense the respective above described parameters, while sensors 11–13 actually sense each a single parameter of an environment in the vicinity to the doll. Each of the sensors 11–13 can be turned off by switches 15', 15'' and 15''' respectively so that a respective one of the sensors 11–13 does not sense the respective parameter of the environment, when desired. The sensor 14 is preferably always on. The turning off and on of the sensors 11–13 can be performed in a known manner, for example manually by a child by acting on the respective switch 15'–15'''. On the other hand, the turning on and off can also be done for example by the stethoscope 58 or more particularly by bringing the magnet 41 close to the respective switch 15'–15'''.

The sensors 11, 12 and 13 are known sensors which are used in the art for sensing respectively noise, smoke, temperature, and producing impulse signals when the above parameters exceed a predetermined level or threshold. The sensitivity of each of the sensors 11–13 (their threshold) can be adjusted for example by potentiometers 16, 17, 18 and 21. The impulse signal pass further through threshold devices 19, 20, 25 and 26 and differentiators 23, 24, 27 and 28. Then a single impulse is separated (formed when the impulse signal exceeds the threshold of operation.

When the impulse signal is supplied from at least one of the sensors 11–13, a trigger 33 turns its position (switches) and actuates a delay element 31 which is set to provide a delay of approximately 30–40 sec. As a result of this a sonic transducer 36 is actuated and it produces a sound which imitates for example crying which is performed during the time determined by the delay element. The multiplexer 5, the impulse signal with a frequency of approximately 2 Hz from the generator 4 (higher than 1.2 Hz from the generator 3) and the light sources 9 and 10 produce the image of expanding and contracting heart by with a higher frequency. In other words, when the doll "experiences" cold or hot temperature, "is subjected" to high noise or is "near" a smoking person, its heart "beats" faster and it "cries". When an impulse signal is supplied from the sensor 11 or the sensor 12, a trigger 34 is actuated and a light source 39 is turned on which the frequency of 2 Hz (frequency of "high heart beat"). The light source 39 is located in the doll in the area of its stomach and, when it is on, it produces the image of a butterfly in the "stomach" of the doll, thus imitating nervousness or fear when there is noise or smoke around the doll. The manner of the producing of the butterfly image can be the same as in the case of the image of expanding and contracting heart, or in any other manner. For example, liquid crystal display can be used for the production of the butterfly image. This is also applicable with respect to the image of expanding and contracting heart: it can also be done on liquid crystals, etc.

When the impulse signal is supplied from the temperature sensor 13 which takes place when the temperature of environment decreases (it becomes cold), a trigger 35 is actuated and the light source 40 is turned on and operates with the frequency of 2 Hz (frequency of "high heart beat"). The light source 40 is located in the doll in the area of its throat and, when it is on, it produces the image of a frog in the "throat" of the doll, thus imitating that the doll cold (catches cold).

Stopping (turning off) of each video signal (the images of the heart, the butterfly, the frog) of audio signal (heart beat, crying) emitted by the doll can be performed in 30–40 sec. as described hereinabove from the signal supplied by the delay element 31. On the other hand, this can also be performed in response to the impulse signal supplied from the sensor 14 with a delay of 5–9 sec., for example, produced by a delay element 22. The sensor 14 is a rocking sensor and it operates when a child rocks (or performs other shake-like movements of the doll). Generally, when a child does not rock the doll, it continues crying, exhibiting the heart, frog and butterfly images, having a heart beat. When a child rocks the doll, these signals stop. Thus, the child's care (rocking of the doll) silences the doll.

Figure 5:
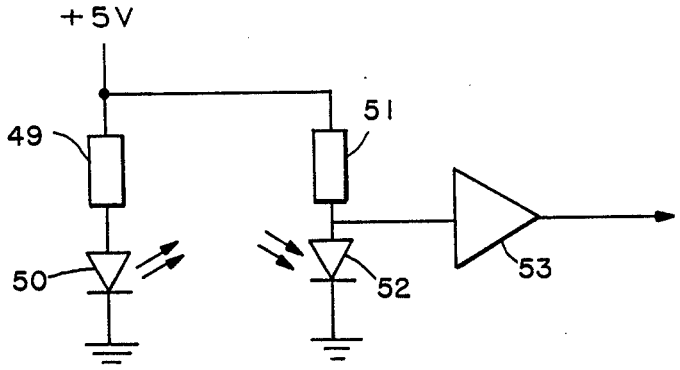
FIGS. 5 and 6 are views showing a rocking sensor which senses rocking of the doll by a child.
Figure 6:
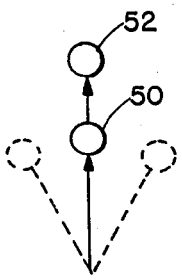

An electrical rocking sensor is shown in FIGS. 5 and 6. When the doll is not touched (rocked, moved) light from a light-emitting diode 50 passes to a photodiode 52 and there is not signal at the output of the sensor. When the doll is rocked, the light-emitting diode 50 swings for example on a flat spring, the light does not pass to the photodiode 52, and there is not signal at the output of the sensor. The light-emitting diode preferably swings in a vertical plane transversely to the doll's body when the doll lies on its back. This is how it has to be oriented so that rocking of the lying doll from the right to the left actuates the sensor 14.

Figure 7:
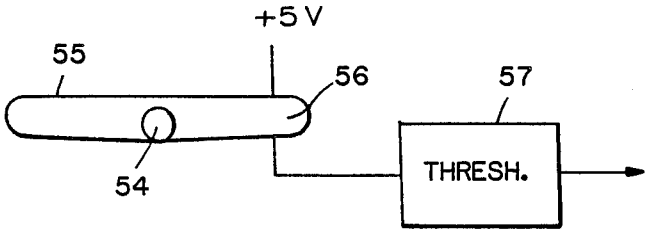
FIG. 7 is a view showing a rocking sensor of the doll in accordance with another embodiment of the present invention.
Figure 8:
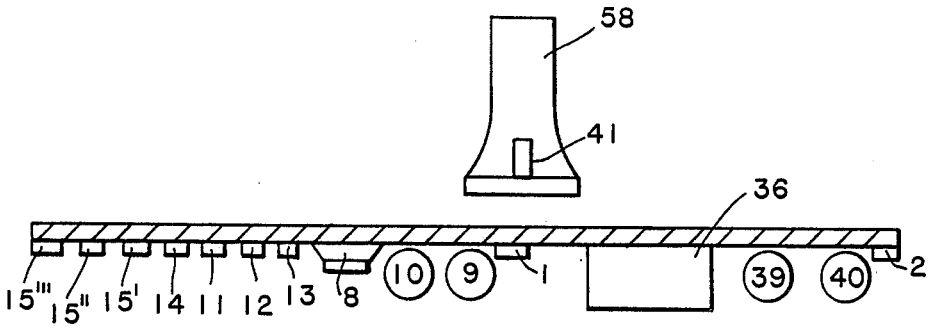
FIG. 8 is a view showing arrangement of respective parts of the inventive doll inside a housing of the doll.

The rocking sensor in accordance with another embodiment is shown in FIG. 7 which is a vertical cross section of the doll. The doll has a channel 55 with a small depression in its bottom. When the doll is not rocked a current-conductive ball rests in the depression of the channel 55 and electrical contacts 56 are open. When the doll is rocked by a child, the ball 54 moves to the right and closes the contacts 56 thus producing a signal at the outlet of the sensor.

The tape recorder 38 is provided with a sound transducer 81 and a unit which includes a diode 82, a resistor 83, a capacitor 84 and a transistor 85. When the impulse signal is supplied to the tape recorder 36 it passes momentarily to the tape recorder through the diode 82 and turns on the tape recorder so that the doll cries. When the child rocks the doll and signal from rocking sensor resets trigger 33 the doll does not stop "crying" immediately, since capacitor discharge cannot take plate through the diode 82, but instead it takes place through the resistor 83. Moreover, the resistance on the transistor increases and the crying not only stops after a certain delay, but also gradually weakens (the sound of crying becomes less and less loud).

It should be emphasized that the "butterfly in stomach" and the "frog in throat" images in the doll correspond to accepted idiomatic expressions in English language, and therefore teach the children their heritage and have a great educational value.

Figure 9:
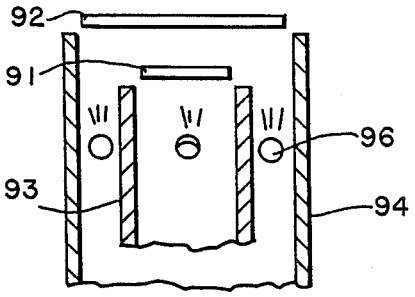
FIG. 9 is a view schematically showing a doll heart imitating display in accordance with another embodiment of the present invention.

FIG. 9 shows another embodiment of the display which forms the image of expanding and contracting heart. It has a smaller heart-shaped member 01 and a bigger heart-shaped member 92 associated with the inner tube 93 and outer tube 94. The heart-shaped members are transparent and colored, provided with light-spurces, for example LED 96 behind them. The light source inside the inner tube 93 can be always on, while the light sources between the inner tube 93 and the outer tube 94 can be on and off. Therefore, the image of expanding and contracting heart is formed.

The electronic means can be supplied, for example from a battery, which can be rechargeable. It can also be supplied from electrical network.

Figure 10:
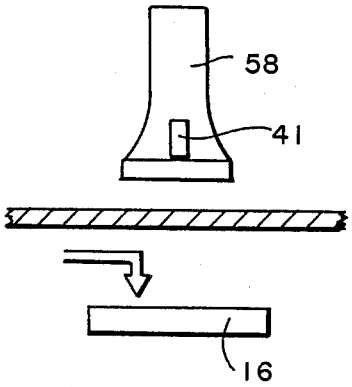
FIG. 10 shows adjustment of sensor's sensitivity.

FIG. 10 shows how the level of sensitivity of the sensors can be adjusted from outside of the doll. A movable adjusting member of the potentiometers, for example of the potentiometer 16 can be displaced along the potentiometer by the magnet of the stethoscope movable outside the doll's wall near the adjusting member.

The invention is not limited to the details shown since various modifications and structural changes are possible without departing from the spirit of the present invention.

What is desired to be protected by Letters Patent is set forth in particular in the appended claims.

I claim:

1. A doll comprising:

a doll;

sensing means arranged to sense at least one condition of sound, smoke, noise and temperature of the environment in the vicinity of said doll means responsive to said sensing means for forming a picture inside the doll and displaying said picture on an outside surface of the doll.

2. A doll as defined in claim 1, wherein said sensing means is formed so that it senses a temperature which exceeds a predetermined level, said means forming said pictures in response to sensing of said temperature by said sensing means.

3. A doll as defined in claim 1, wherein said sensing means is formed so that it senses smoke in the environment, said means forming said pictures in response to sensing of smoke by said sensing means.

4. A doll as defined in claim 1, wherein said sensing means is formed so that it senses sound which exceeds a predetermined level, said means forming said pictures in response to sensing of said sound by said sensing means.

5. A doll as defined in claim 1; and further comprising further means arranged to produce a sound of crying in response to sensing of said one condition by said sensing means.

6. A doll as defined in claim 1; and further comprising additional means arranged to form an image of a butterfly in a stomach area of the doll in response to sensing of said one condition by said sensing means.

7. A doll as defined in claim 1; and further comprising supplemental means arranged to form an image of a frog in a throat area of the doll in response to sensing of said one condition by said sensing means.

8. A doll as defined in claim 1; and further including means for turning off said sensing means; comprising an element formed so that when it is placed near said pictures forming means said pictures forming means forms said pictures of the expanding and contracting heart.

9. A doll element as defined in claim 1; and further including means for adjusting a sensitivity of said sensing means so as to change a level of said condition, which causes said sensing means to form said pictures.

10. A doll as defined in claim 1, wherein said sensing means includes a plurality of sensors each sensing different conditions of the environment and connected with said pictures forming means so that the latter forms said pictures in response to sensing said conditions by said sensors; and further comprising means for turning off at least one said sensors so that the respective condition is not sensed by said turned off sensor.

11. A doll as defined in claim 1, wherein said sensing means includes a plurality of sensors sensing different conditions of environment and connected with said pictures forming means so that the latter form said pictures in response to sensing said conditions by said sensors.

12. A doll as defined in claim 1; and further comprising further means arranged to produce a sound of crying in response to sensing of said one condition; a movement sensor arranged to sense a rocking of said doll and connected with said further means to cause the further means to stop production of sound in response to sensing of the rocking of said doll element.

13. A doll as defined in claim 12; and further comprising delay means connected with said further means to produce a sound of crying and to maintain the sound of crying for a predetermine time when a user stops rocking said doll.

14. A doll as defined in claim 12, wherein said movement sensor includes at least two members, and a circuit connected therewith, one of said members being fixedly connected with said doll, while the other of said members is connected with said doll to move from a first position to a second position in response to rocking of the doll, said circuit being closed to cause the further means to produce said sound of crying, when said doll element is rocked and said other member moves away from said one member and said circuit is opened so that the production of the sound of crying by said further means is stopped when the moveable member is in its second position and said circuit being opened to prohibit said further means from producing said sound of crying.

15. A doll as defined in claim 12, wherein said movement sensor includes a circuit and a current conductive moveable member arranged so that when said doll element is not rocked said moveable member does not close said circuit and said further means produces said sound of crying, and wherein when said doll element is rocked said moveable member moves and closes said circuit so that the further means causes production of the sound of crying.

16. A doll element as defined in claim 12; and further comprising stopping means connected with said further means when a user stops rocking said doll element to weaken the sound of crying gradually until it completely diappears.

17. A doll element as defined in claim 1; and further comprising means for adjusting a level of sensitivity of said sensing means and including a movable metal adjusting member whose movement changes the sensitivity of said sensing means and which is located inside the doll, and a magnetic member displaceable by a user outside the doll so as to move said metal adjusting member magnetically through a doll's wall.

18. A doll as defined in claim 1, wherein the picture is that of an expanding and contracting heart.

19. A doll as defined in claim 18, wherein said pictures forming means includes a display means located inside said doll so that said pictures of said expanding and contracting heart is formed on said display and visible through said doll element from outside.

20. A doll as defined in claim 18; and further comprising sound generating means arranged so that it generates sounds imitating a heart beat in response to sensing of said one condition by said sensing means.

21. A doll defined in claim 18; and further comprising modifying means arranged to cause said picture forming means to increase an image of a heart beat rate caused by the picture of the expanding and contracting heart.

22. A doll as defined in claim 18; and further comprising delay means maintaining said pictures of said expanding and contracting heart only during a certain time, after which said image disappears.

23. A doll as defined in claim 18, wherein the picture of the heart is in a chest area of the doll.

24. A doll as defined in claim 1, wherein the picture is that of a butterfly in a stomach of the doll.

25. A doll as defined in claim 1, wherein the picture is a frog in a throat of the doll.

26. A doll as defined in claim 1 wherein one of a plurality of different pictures are formed and wherein the pictures embody idiomatic English expressions.

* * * * *